US009915093B2

(12) United States Patent
Weisbeck et al.

(10) Patent No.: US 9,915,093 B2
(45) Date of Patent: Mar. 13, 2018

(54) SECURITY GATE

(71) Applicant: North States Industries, Inc., Blaine, MN (US)

(72) Inventors: Dean Weisbeck, Medina, MN (US); Julie Ann Yager Grad, Deephaven, MN (US)

(73) Assignee: North States Industries, Inc., Plymouth, MN (US)

( * ) Notice: Subject to any disclaimer, the term of this patent is extended or adjusted under 35 U.S.C. 154(b) by 6 days.

(21) Appl. No.: 15/229,325

(22) Filed: Aug. 5, 2016

(65) Prior Publication Data

US 2017/0037678 A1 Feb. 9, 2017

Related U.S. Application Data

(60) Provisional application No. 62/201,948, filed on Aug. 6, 2015.

(51) Int. Cl.

| | |
|---|---|
| ***E06B 7/32*** | (2006.01) |
| ***E06B 9/04*** | (2006.01) |
| ***E05C 19/18*** | (2006.01) |
| ***E05B 65/00*** | (2006.01) |
| ***E05C 3/04*** | (2006.01) |
| ***E05C 7/00*** | (2006.01) |
| *E06B 9/00* | (2006.01) |

(52) U.S. Cl.

CPC ..... *E06B 9/04* (2013.01); *E05B 65/0007* (2013.01); *E05C 3/044* (2013.01); *E05C 7/00* (2013.01); *E05C 19/188* (2013.01); *E06B 7/32* (2013.01); *E05B 65/0014* (2013.01); *E06B 2009/002* (2013.01)

(58) Field of Classification Search

CPC ..... E06B 7/32; E06B 2009/002; E06B 9/04; E06B 9/02; E05B 65/0007

See application file for complete search history.

(56) References Cited

U.S. PATENT DOCUMENTS

| | | | | |
|---|---|---|---|---|
| 1,542,151 A | | 6/1925 | Lehtonen | |
| 3,985,174 A | * | 10/1976 | Bricker | E06B 7/32 160/180 |
| 4,053,007 A | * | 10/1977 | Griffith | E06B 7/32 160/180 |

(Continued)

FOREIGN PATENT DOCUMENTS

| | | |
|---|---|---|
| CA | 152521 | 6/2014 |

OTHER PUBLICATIONS

Pet Gates http://www.carlsonpetproducts.com/products/petgates/ 2 pages (retrieved Jul. 18, 2016).

(Continued)

*Primary Examiner* — Justin B Rephann
(74) *Attorney, Agent, or Firm* — Merchant & Gould P.C.

(57) ABSTRACT

A security gate including an outer gate and an inner gate for selective passage of people and/or pets therethrough. In one example, the security gate includes: an outer frame; an outer gate at least partially disposed within the outer frame; an inner gate disposed within the outer gate, the inner gate comprising an inner frame having at least one recess; a door at least partially disposed within the inner frame; and at least one projection extending from the outer gate and engaging the at least one recess for supporting the inner gate within the outer gate.

19 Claims, 5 Drawing Sheets

(56) References Cited

U.S. PATENT DOCUMENTS 4,334,573 A * 6/1982 Hackman ..... E06B 7/32 160/180
4,583,715 A * 4/1986 Wright ..... E01F 13/06 160/225
4,607,455 A 8/1986 Bluem et al.
4,628,635 A * 12/1986 Maillard ..... E06B 9/02 49/55
4,677,791 A 7/1987 Larson et al.
4,685,247 A 8/1987 Alarm
4,760,872 A * 8/1988 Hale, Jr. ..... E06B 7/32 160/180
4,776,133 A * 10/1988 Green ..... E06B 7/32 49/169
4,777,765 A * 10/1988 Johnson, Jr. ..... E06B 9/02 49/395
5,117,585 A * 6/1992 Andrisin, III ..... E06B 9/04 49/55
5,185,954 A * 2/1993 Waddle, Sr. ..... E06B 7/32 49/168
5,287,654 A * 2/1994 Davlantes ..... A01K 1/035 47/56
5,442,881 A * 8/1995 Asbach ..... E05B 65/0007 49/13
5,535,550 A * 7/1996 Yang ..... E05B 5/1053 292/92
5,544,870 A 8/1996 Kelley et al.
5,551,188 A * 9/1996 Davlantes ..... E05B 13/005 292/132
5,657,592 A * 8/1997 Davlantes ..... E06B 7/32 49/168
5,735,079 A * 4/1998 Davlantes ..... E06B 7/32 49/169
5,946,855 A * 9/1999 Miconi ..... E06B 7/32 160/180
6,027,104 A 2/2000 Alexander et al.
D422,367 S 4/2000 Mishina
6,161,334 A 12/2000 Goodin
6,385,909 B1 * 5/2002 Marsh ..... E06B 7/32 49/168
6,446,395 B2 9/2002 Rogers
6,681,523 B1 1/2004 Stener
6,681,524 B1 * 1/2004 Tillson ..... E06B 7/32 160/180
6,681,720 B1 1/2004 Skurdalsvold et al.
6,725,806 B1 * 4/2004 Gribble ..... E06B 7/32 119/484
D577,465 S 9/2008 Eren
7,950,184 B2 5/2011 Flannery
7,975,431 B2 7/2011 Flannery
7,984,695 B1 * 7/2011 Shaffer ..... E06B 7/32 119/501
8,141,517 B2 3/2012 Shimoda et al.
8,434,264 B2 * 5/2013 Bosserdet, Jr. ..... E06B 7/32 49/168
8,448,381 B2 5/2013 Flannery
D708,354 S 7/2014 Weisbeck et al.
8,997,400 B2 * 4/2015 Louie ..... E06B 7/32 49/169
9,127,496 B1 * 9/2015 Flannery ..... E06B 9/06
9,382,740 B2 * 7/2016 Flannery ..... E05D 7/10
9,382,750 B1 * 7/2016 Flannery ..... E06B 9/00
9,447,631 B2 * 9/2016 Christie ..... E06B 7/32
9,689,197 B1 * 6/2017 Flannery ..... E05L 315/022
2005/0028947 A1 * 2/2005 Waldman ..... E05L 317/2053 160/215
2006/0107901 A1 * 5/2006 Hirokawa ..... A01K 1/0005 119/452
2006/0169217 A1 8/2006 Glassford
2007/0017156 A1 1/2007 Robinson et al.
2007/0074453 A1 * 4/2007 Flannery ..... E06B 9/04 49/57
2007/0227462 A1 10/2007 Huff
2008/0110412 A1 * 5/2008 Shimoda ..... A01K 1/034 119/473
2008/0265233 A1 * 10/2008 Flannery ..... E06B 9/04 256/73
2009/0293363 A1 * 12/2009 Flannery ..... E06B 7/32 49/55
2010/0269413 A1 * 10/2010 Sullivan ..... E06B 7/32 49/171
2012/0233922 A1 * 9/2012 Flannery ..... E06B 7/32 49/55
2013/0036672 A1 * 2/2013 Westerfield ..... E06B 7/32 49/62
2013/0160365 A1 * 6/2013 Flannery ..... E06B 9/04 49/50
2014/0061563 A1 3/2014 Weisbeck et al.
2015/0021932 A1 * 1/2015 Horwood ..... E05C 3/124 292/224

OTHER PUBLICATIONS

Walk-Thru with Pet door http://www.carlsonpetproducts.com/products/petgates/walkthruwithpetdoor/ 2 pages (retrieved Jul. 18, 2016).
Iris 4Panel Pet Pen http://www.petsmart.com/dog/pens/iris4panelpetpenzid366817/cat36catid1001071 1 page (retrieved Jul. 18, 2016).
Precision Pet Exercise Pen with Door http://www.petsmart.com/dog/pens/precision-pet-exercise-pen-with-door-zid36-6840/cat-36-catid-100107 1 page (retrieved Jul. 27, 2016).
Auto-close Pet Gate http://www.wayfair.com/Auto-close-Pet-Gate-33661-G17-PZQ1028.html 3 pages (retrieved Jul. 20, 2016).

* cited by examiner

SECURITY GATE

CROSS-REFERENCE TO RELATED APPLICATIONS

This application claims the benefit of U.S. Provisional Application No. 62/201,948, filed Aug. 6, 2015, the entirety of which is hereby incorporated by reference.

BACKGROUND

Security gates are commonly used to lock or close passageways such as conventional doorways and entrances to stairwells. The purpose of such gates is primarily security, such as keeping small children from accessing stairwells that could present a hazard, and also confinement, such as confining a pet to a particular room during the night.

A typical security gate is formed from one or more panels, each panel including a frame surrounding a lattice structure (e.g., a mesh) or series of bars formed therebetween so that one can see through the gate when the gate is in place.

Typically, the outer frame of a security gate is manually positioned between two stationary elements, such as a doorjamb. The security gate is then locked in place by a locking mechanism.

There is a need for user friendly security gates with multiple or compound passageways to allow selective access therethrough by different pets, children, and so forth.

SUMMARY

In one aspect, an example security gate includes: an outer frame; an outer gate at least partially disposed within the outer frame; an inner gate disposed within the outer gate, the inner gate comprising an inner frame having at least one recess; a door at least partially disposed within the inner frame; and at least one projection extending from the outer gate and engaging the at least one recess for supporting the inner gate within the outer gate.

DETAILED DESCRIPTION

Figure 1:
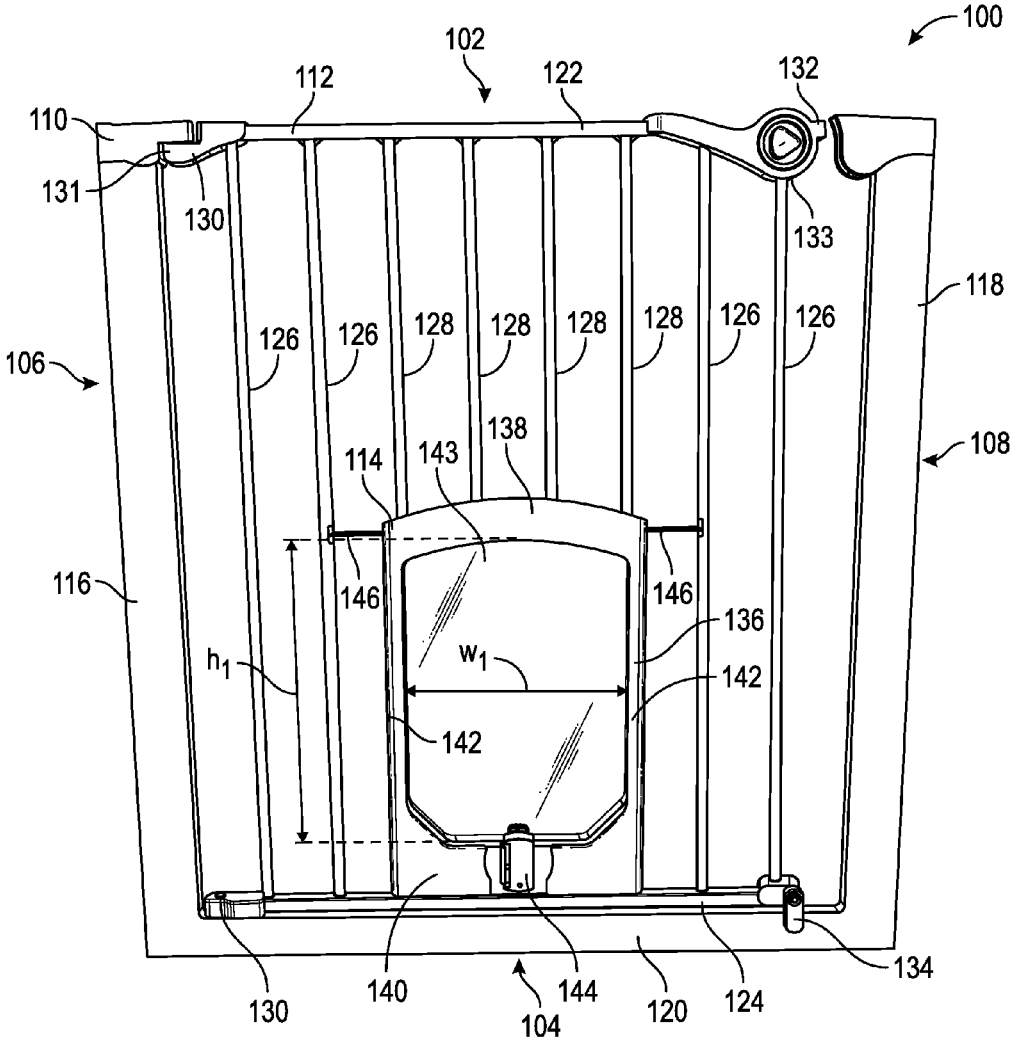
FIG. 1 is a front view of an example security gate in accordance with the present disclosure.

The present disclosure is directed towards a security gate. Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a front view of an example security gate 100 in accordance with the present disclosure. The security gate 100 has a top 102, a bottom 104, a first side 106, and a second side 108, and includes an outer frame 110, an outer gate 112, and an inner gate 114. The outer frame 110 includes a first vertical member 116, a second vertical member 118, and a horizontal member 120. The outer gate 112 includes a first outer rail 122, a second outer rail 124, one or more complete inner rails 126, one or more partial inner rails 128, one or more connectors 130 disposed towards a proximal side 131 of the outer gate 112, a latch 132 disposed towards a distal side 133 of the outer gate 112, the distal side 133 being opposite the proximal side 131, and a first locking mechanism 134. The inner gate 114 includes an inner frame 136 having a top member 138, a bottom member 140, and side members 142; the inner gate 114 also including a door 143 and a second locking mechanism 144. Optionally, the security gate 100 includes one or more inner gate supports 146.

The security gate 100 may be used as a pressure-mounted gate, e.g., by placing the security gate 100 between stationary objects (such as a doorjamb) such that frictional pressure between the security gate 100 and the stationary objects keeps the security gate 100 upright. It should be appreciated that the security gate 100 may include one or more elements that apply pressure to stationary objects; in addition or alternatively, the security gate 100 may be coupled to one or more elements that apply such pressure (e.g., by expanding into the doorjamb). Alternatively, the security gate 100 may be coupled to a larger portable enclosing structure, such as a fence structure that spans an opening wider than the security gate 100. Similarly, the security gate 100 may be coupled to one or more elements of a portable enclosure (e.g., a play yard) having multiple fence panels which, when coupled to the security gate 100, form a self-contained enclosure for pets and/or children.

The outer frame 110 houses the outer gate 112 and interfaces with one or more other elements of an enclosure to secure the security gate 100 in place. The inner gate 114 is disposed within the outer gate 112. In this example the outer gate 112 consists of the first vertical member 116 and the second vertical member 118 extending upwards from opposing ends of the horizontal member 120, the horizontal member being disposed at the bottom 104 of the security gate 100. Alternative configurations for the outer frame 110 are also possible. By way of non-limiting example, the horizontal member 120 can be disposed at the top 102 of the security gate 100, with the first vertical member 116 and the second vertical member 118 extending downwards from the horizontal member 120 towards the bottom 104 of the security gate 100.

In the example shown, the first outer rail 122 and the second outer rail 124 define a height $h_1$ of the outer gate 112. In alternative examples, the first outer rail 122 and the second outer rail 124 can define a different dimension of the outer gate 112, such as the approximate width between the first vertical member 116 and the second vertical member 118 of the outer frame 110.

The one or more complete inner rails 126 span the distance between, and are connected at opposite ends, respectively, to, the first outer rail 122 and the second outer rail 124. The one or more partial inner rails 128 connect the first outer rail 122 to the inner gate 114. In some examples, the one or more partial inner rails 128 connect the first outer rail 122 to the top member 138 of the inner frame 136 of the inner gate 114. In one non-exhaustive alternative example, the one or more partial inner rails 128 connect the second outer rail 124 to the inner gate 114.

In the security gate 100 shown in FIG. 1, the one or more partial inner rails 128 are at least substantially parallel to the one or more complete inner rails 126. In addition, in this example the partial inner rails 128 are disposed between the complete inner rails 126 towards both the first side 106 and the second side 108 of the security gate 100, i.e., the inner gate 114 is at least approximately centralized between the first side 106 and the second side 108 of the security gate 100. It should be appreciated, however, that the inner gate 114 can be secured within the outer gate 112 in alternative ways (e.g., with one or more supports connected directly or indirectly to one or more of the outer rails of the outer gate 112); similarly, the inner gate 114 can be placed at any location within the outer gate 112, with the disposition of the complete inner rails 126 and the partial inner rails 128 (or other attachment mechanism) adjusted accordingly. In some examples the complete inner rails 126 and the partial inner rails 128 are spaced sufficiently close to one another and sufficiently close to the first vertical member 116 and the second vertical member 118 to prevent a pet and/or child from moving through or getting caught between adjacent rails (126, 128), and/or between a rail (126, 128) and the first vertical member 116 or the second vertical member 118.

The connectors 130 movably connect the proximal side 131 of the outer gate 112 to the outer frame 110. In some examples the connectors 130 are pivoting connectors, allowing the outer gate 112 to swing or rotate about the connectors 130 relative to the outer frame 110. Non-limiting examples of the connectors 130 include hinges, pin-socket connections, and so forth.

The latch 132 detachably connects the distal side 133 of the outer gate 112 to the outer frame 110, enabling the outer gate 112 to be opened (i.e., when the latch 132 is detached from the outer frame 110) and closed (i.e., when the latch 132 is connected to the outer frame 110). In general terms the outer gate 112 is an opened position when a first plane defined by the first outer rail 122 and the second outer rail 124 does not coincide with a second plane defined by the first vertical member 116 and the second vertical member 118 of the outer frame 110 and/or when both the latch 132 is detached from the outer frame 110 and the first locking mechanism 134 is unlocked; the outer gate 112 is in a closed position when the aforementioned first plane does coincide with the aforementioned second plane and one or both of the first locking mechanism is locked and the latch 132 is connected to the outer frame 110.

In some examples, the latch 132 includes an extendable and retractable projection operated by a spring biased button that extends the protrusion into (when the button is released), and retracts the protrusion from (when the button is pressed), a recess in the outer frame 110 that frictionally mates with the protrusion.

The first locking mechanism 134 provides for locking of the outer gate 112 in a closed position, regardless of whether the latch 132 is connected to the outer frame 110. The first locking mechanism 134 can be disposed anywhere on the outer gate 112 suitable for this purpose. In the example shown in FIG. 1, the first locking mechanism 134 is disposed towards the distal end 133 of the outer gate 112 and reversibly engages the outer frame 110 to lock (i.e., when the first locking mechanism engages the outer frame 110) and unlock (i.e., when the first locking mechanism 134 does not engage the outer frame 110) the outer gate 112.

The outer gate 112 is larger than the inner gate 114. Thus, the latch 132 and/or the first locking mechanism 134 may be operated to selectively allow or disallow large animals or children to pass through the security gate 100, while operation of the inner gate 114 (discussed in more detail below), selectively allows relatively smaller animals or objects to pass through the security gate 100.

In some examples, the first locking mechanism 134 is detachable, meaning it can be detached from, and reattached to, the outer gate 112. When attached to the outer gate 112 as shown, the first locking mechanism 134 increases the profile depth of the security gate 100 from front to back when the security gate 100 is in the position shown in FIG. 1. A removable first locking mechanism 134 thus facilitates storage and shipment of the security gate 100 by enabling a shorter profile depth for the security gate 100 by simply removing the first locking mechanism 134. Thus, in some examples, the first locking mechanism 134 and one or more other components of the security gate 100 together constitute a security gate assembly. A removable first locking mechanism 134 also facilitates selling the first locking mechanism 134 individually as a separate part of the security gate 100.

The inner frame 136 defines an opening in the inner gate 114. Relatively small pets or other objects may be selectively allowed to pass through the opening defined by the inner frame 136, regardless of whether the outer gate 112 is closed or open.

In the example shown in FIG. 1, the top member 138 of the inner frame 136 couples to one or more of the partial inner rails 128, thereby securing at least an upper portion of the inner gate 114 to the outer gate 112. In the example shown in FIG. 1, the bottom member 140 of the inner frame 136 couples to the second outer rail 124, thereby securing at least a lower portion of the inner gate 114 to the outer gate 112. Optionally, one or more inner gate supports 146 couples one or both of the side members 142 of the inner frame 136 to one or more complete inner rails 126, thereby securing at least a side portion of the inner gate 114 to the outer gate 112. It should be appreciated that in alternative embodiments in which the inner gate 114 is disposed relative to the outer gate 112 differently from what is shown in FIG. 1, one or more components of the inner frame 136 may couple to one or more alternative components of the outer gate 112.

The door 143 is shaped and sized to at least approximately correspond to the opening defined by the inner frame 136. In some examples the door 143 is made from a continuous piece of material (i.e., without any gaps or holes within the door 143). In some examples, the door 143 is pivotally coupled to one or more of the top member 138 and the side members 142 toward the top member 138, allowing the door to swing forwards (out of the page in FIG. 1) and rearwards (into the page in FIG. 1) about the pivot or pivots.

In some examples, the width $w_1$ of the opening defined by the inner frame 136, which approximately corresponds to the width of the door 143, is in a range from about 6 inches to about 12 inches. In a specific example, the width $w_1$ is approximately 8 inches. Widths $w_1$ outside of these values would also be suitable. In some examples, the maximum height $h_1$ of the opening defined by the inner frame 136, which approximately corresponds to the maximum height of the door 143, is in a range from about 8 inches to about 15 inches. In a specific example, the maximum height $h_1$ is approximately 11 inches. Maximum heights $h_1$ outside of these values would also be suitable.

The second locking mechanism 144 is mounted to the bottom member 140 of the inner frame 136. In some examples the second locking mechanism 144 is removably mounted to the inner frame 136. A removable second locking mechanism 144 thus facilitates storage and shipment of the security gate 100 by enabling a shorter profile depth for the security gate 100 by simply removing the second locking mechanism 144. Thus, in some examples, the second locking mechanism 144 and one or more other components of the security gate 100 (e.g., the first locking mechanism 134) together constitute a security gate assembly. A removable second locking mechanism 144 also facilitates selling the second locking mechanism 144 individually as a separate part of the security gate 100.

The second locking mechanism 144 reversibly engages the door 143 for locking and unlocking the door 143 within the opening defined by the inner frame 136. In some examples, the door 143 has an open position, a partially closed position, and a closed position. In other examples, the door 143 has an open position and a closed position only. In the open position, the second locking mechanism 144 does not inhibit movement of the door 143. In the closed position, the second locking mechanism 144 prevents movement of the door 143 frontwards (out of the page in FIG. 1) and rearwards (into the page in FIG. 1). In the partially closed position, the second locking mechanism 144 prevents movement of the door 143 in one but not both of the frontwards and rearwards directions.

In some examples, actuation of the second locking mechanism 144 (e.g., the amount of force required and/or the dexterity required to actuate the second locking mechanism 144) can be performed by adults, but not by small children or animals.

Figure 2:
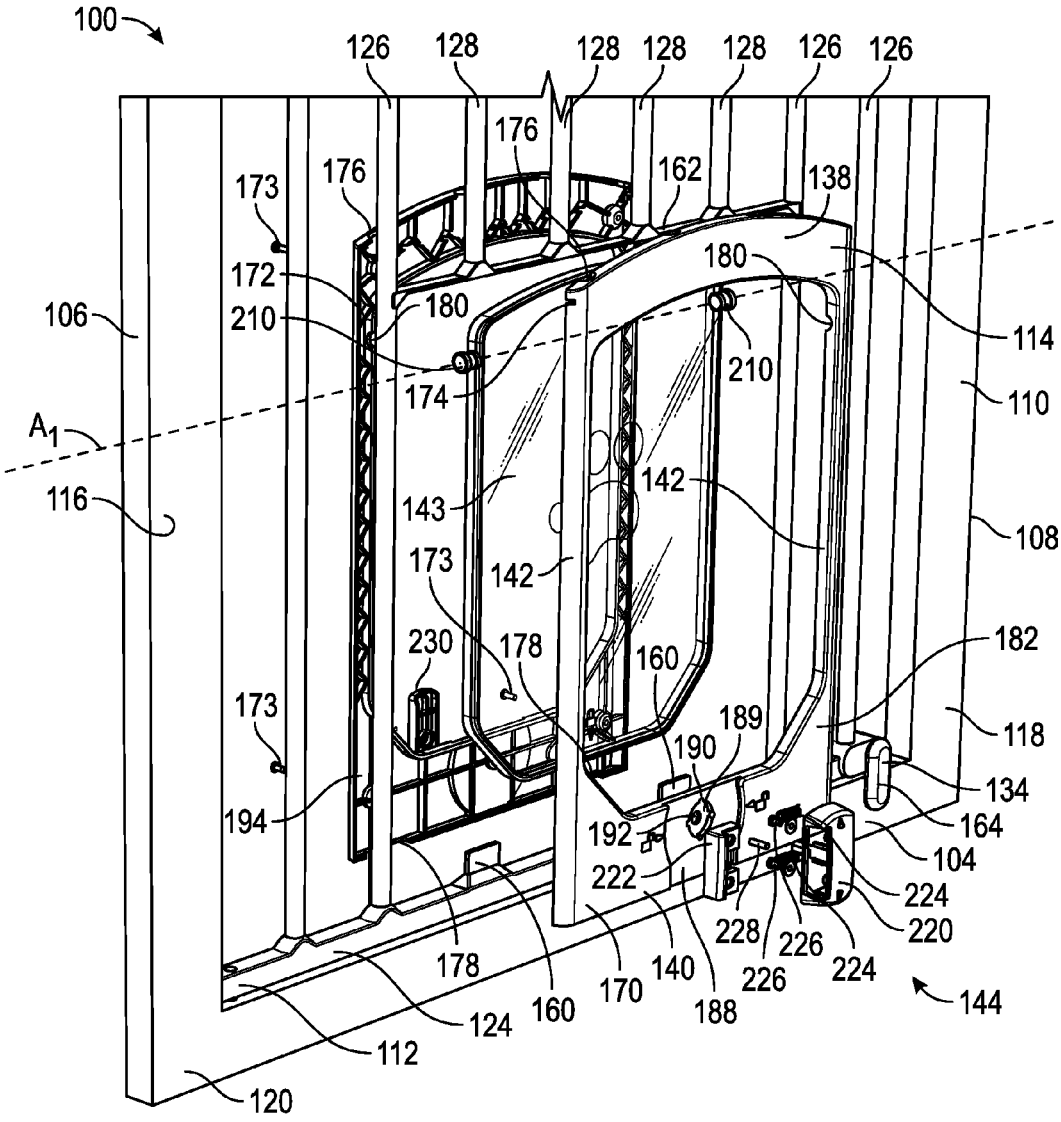
FIG. 2 is an exploded, front perspective view of a portion of the security gate of FIG. 1 without the inner gate supports shown in FIG. 1.
Figure 3:
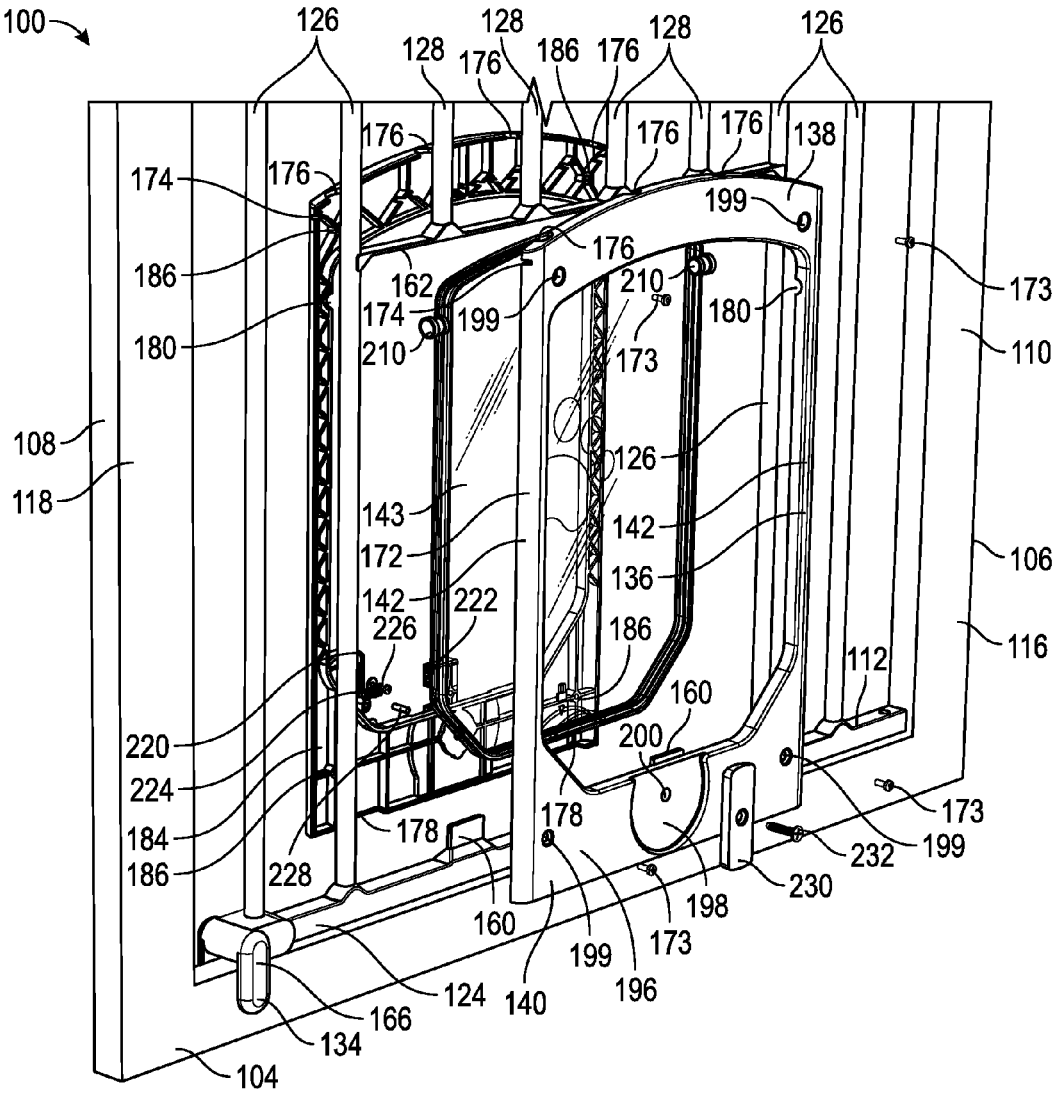
FIG. 3 is an exploded, rear perspective view of a portion of the security gate of FIG. 1 without the inner gate supports shown in FIG. 1.

FIG. 2 is an exploded, front perspective view of a portion of the security gate 100 of FIG. 1 without the inner gate supports 146; FIG. 3 is an exploded, rear perspective view of a portion of the security gate 100 of FIG. 1 without the inner gate supports 146. With reference to FIGS. 2-3, the security gate 100 includes the bottom 104, the first side 106, the second side 108, the outer frame 110 having the first vertical member 116, the second vertical member 118 and the horizontal member 120, the security gate 100 further including the outer gate 112 having the second outer rail 124, the one or more complete inner rails 126, the one or more partial inner rails 128 and the first locking mechanism 134, the security gate 100 further comprising the inner gate 114 having the inner frame 136, the top member 138, the bottom member 140, the side members 142, the door 143, and the second locking mechanism 144, as discussed above.

In addition, in this example the outer gate 112 includes one or more projections 160, and a crossbar 162, and the first locking mechanism 134 includes a first handle 164 and a second handle 166. In addition, in this example the inner frame 136 includes a front panel 170, a rear panel 172 and one or more screws 173. Each of the front panel 170 and the rear panel 172 includes a slot 174, one or more notches 176, one or more recesses 178, and one or more cutouts 180. The front panel 170 includes a front side 182, a rear side 184, one or more screw receivers 186, an upper knob depression 188, and a lower knob depression 189 having one or more fingers 190 and a knob hole 192. The rear panel 172 includes a front side 194, a rear side 196, a tab depression 198, one or more panel screw holes 199, and a tab screw hole 200. Also in this example the door 143 includes one or more protrusions 210. In addition, in this example the second locking mechanism 144 includes a knob 220, a button 222, one or more springs 224, one or more button connectors 226, a pin 228, a tab 230, and a tab screw 232.

The one or more projections 160 extend upwards from the second outer rail 124. In some examples, the one or more projections 160 are made from the same material as the second outer rail 124. The crossbar 162 spans across the bottoms of the one or more partial inner rails 128, extending on one or both sides to an adjacent complete inner rail 126. The first handle 164 of the first locking mechanism 134 is disposed on the front side of the outer gate 112.

When the outer gate 112 is aligned with the outer frame 110, rotating the first handle 164 of the first locking mechanism 134 downwards to the downward position shown in FIG. 2 (or a position substantially similar thereto), prevents the outer gate 112 from opening rearwards, as an attempt to open the gate rearwards results in the first handle 164 interfacing with the horizontal member 120 in a plane perpendicular to the direction of the attempted opening. When the outer gate 112 is aligned with the outer frame 110, rotating the second handle 166 of the first locking mechanism 134 downwards to the downward position shown in FIG. 3 (or a position substantially similar thereto), prevents the outer gate 112 from opening frontwards, as an attempt to open the gate frontwards results in the first handle 164 interfacing with the horizontal member 120 in a plane perpendicular to the direction of the attempted opening.

In some examples the first handle 164 and the second handle 166 can be pivoted independently (e.g., via separate pins that couple each of the handles, respectively, to the second outer rail 124), allowing four options for selective opening of the outer gate 112, including forwards opening only, rearwards opening only, both forwards and rearwards opening, or neither forwards nor rearwards opening. In other examples, the first handle 164 and the second handle 166 can be pivoted in tandem only (e.g., via a single pin that couples both handles to the second outer rail 124), allowing for both forwards and rearwards opening, or neither forwards nor rearwards opening. In some examples, one or both of the first handle 164 and second handle 166 alternatively or in addition can be pivoted to interface with the second vertical member 118 of the outer frame 110, allowing for selective opening of the outer gate 112 in the manners described above. In some examples, multiple locking mechanisms are provided to interface with multiple portions of the outer frame 110.

The front panel 170 and the rear panel 172 couple to each other and the outer gate 112 to form the inner frame 136. In some examples, the front panel 170 and the rear panel 172 are coupled together by the one or more screws 173 that are threaded to the front panel 170 and the rear panel 172 via the one or more panel screw holes 199 and the one or more screw receivers 186. In addition, in some examples the inner frame 136 is further integrated within the outer gate 112 by housing the crossbar 162 in the slot 174 of the front panel 170 and the rear panel 172, by housing one or more complete inner rails 126 and/or partial inner rails 128 in one or more corresponding notches 176 in the front panel 170 and the rear panel 172, and/or by housing one or more projections 160 in the corresponding recesses 178 in the front panel 170 and the rear panel 172. The one or more projections 160 interface with the front panel 170 and the rear panel 172 of the inner frame 136 via the recesses 178, thereby supporting the inner frame 136 within the outer gate 112. The slot 174, the one or more notches 176, and the one or more recesses 178 are disposed in the front panel 170 and the rear panel 172 such that they align with one other respectively, in the other panel, when the front panel 170 and the rear panel 172 are coupled to together to form the inner frame 136.

The one or more cutouts 180 house the one or more protrusions 210 extending from the door 143. The one or more cutouts 180 are disposed in the front panel 170 and the rear panel 172 such that they align with one other, respectively, in the other panel, when the front panel 170 and the rear panel 172 are coupled to together to form the inner frame 136.

The one or more screw receivers 186 are disposed on the rear side 184 of the front panel 170. The one or more panel screw holes 199 extend through the rear panel 172 from the rear side 196 to the front side 194.

In the example shown in FIG. 2, the upper knob depression 188 and the lower knob depression 189 are disposed in the bottom member 140 on the front side 182 of the front panel 170. The upper knob depression 188 is shaped to receive the knob 220 and allow rotational movement of the knob 220 within the upper knob depression 188. The lower knob depression 189 is disposed within the upper knob depression 188 and is depressed rearwards in the front side 182 to a greater degree than the upper knob depression 188. Each of the one or more fingers 190 in the lower knob depression 189 corresponds to a setting (e.g., locked, unlocked) for the first locking mechanism 134. In some examples, the setting is adjusted by pressing the button 222 and rotating the knob 220 and then releasing the button 222 such that a button flange (described below in connection with FIG. 5) rests in the finger 190 corresponding to the desired setting of the first locking mechanism 134.

The knob hole 192 is disposed within the lower knob depression 189 such when the security gate 100 is assembled the knob hole 192 aligns with a corresponding hole in the horizontal member 120 of the outer frame 110, as well as the tab screw hole 200 in the rear panel 172 of the inner frame 136. The tab depression 198 is shaped to receive the tab 230 and allow rotational movement of the tab 230 within the tab depression 198. The tab screw 232 is housed partially within the tab screw hole 200, and extends through the horizontal member 120 of the outer frame 110 and into the knob 220, thereby securing the knob 220 and the tab 230 together across the inner frame 136.

When the door 143 is aligned within the inner frame 136, rotating the knob 220 (e.g., by pressing the button 222 and rotating the knob 220 and then releasing the button 222) such that a button flange (described below in connection with FIG. 5) rests in the finger 190 corresponding to a setting in which a portion of the knob 220 extends above the bottom member 140, the door 143 is prevented from opening frontwards, as an attempt to open the door 143 frontwards results in the door 143 interfacing with the knob 220 in a plane perpendicular to the direction of the attempted opening. When the door 143 is aligned with the inner frame 136, rotating the tab 230 (e.g., by rotating the tab 230 directly or by pressing the button 222 and rotating the knob 220 and then releasing the button 222) such that a button flange (described below in connection with FIG. 5) rests in the finger 190 corresponding to a setting in which a portion of the tab 230 extends above the bottom member 140, the door 143 is prevented from opening rearwards, as an attempt to open the door rearwards results in the door 143 interfacing with the tab 230 in a plane perpendicular to the direction of the attempted opening.

In some examples the knob 220 and the tab 230 can be rotated independently (e.g., via separate pins, screws, or other rotation mechanisms that couple the knob 220 and the tab 230, respectively, to the inner frame 136), allowing four options for selective opening of the door 143, including forwards opening only, rearwards opening only, both forwards and rearwards opening, or neither forwards nor rearwards opening. In other examples, the knob 220 and the tab 230 can be rotated in tandem only (e.g., via a single rotating mechanism that couples both the knob 220 and the tab 230 to the inner frame 136 that, in some examples, can be rotated only when the button 222 is pressed), allowing for both forwards and rearwards opening, or neither forwards nor rearwards opening. In alternative examples to that shown in FIGS. 2-3, one or both of the knob 220 and the tab 230 can be rotated to interface with another portion of the inner frame 136, such as the side members 142 or the top member 138. In some examples, multiple locking mechanisms are provided to interface with multiple portions of the inner frame 136.

Each of the one or more protrusions 210 is housed in a cutout 180, allowing for pivoting (e.g., swinging) motion of the door 143 forwards and rearwards about the axis $A_1$ that runs through and perpendicular to the direction of projection of the one or more protrusions 210 from the door 143. In some examples, interfacing between the one or more protrusions 210 and the one or more cutouts 180 is sufficiently loose when the door 143 is pivoting to allow an animal to actuate the door 143 when the door 143 is not locked by the second locking mechanism 144. In some examples, when the security gate 100 (FIG. 1) is placed upright on a flat surface, the natural rest position of the door 143 (due to the force of gravity) is within the opening formed by the inner frame 136.

Each of the one or more springs 224 couples to the button 222, such that pressing the button 222 goes against the biasing force of the one or more springs 224. Upon release of the button 222, the button 222 reciprocates from the biasing force of the one or more springs 224. The one or more button connectors 226 couple the button 222 to the knob 220 while allowing movement of the button 222 along the longitudinal axis (axes) of the one or more springs 224. In some examples a button connector 226 includes a button screw and a button washer.

Figure 4:
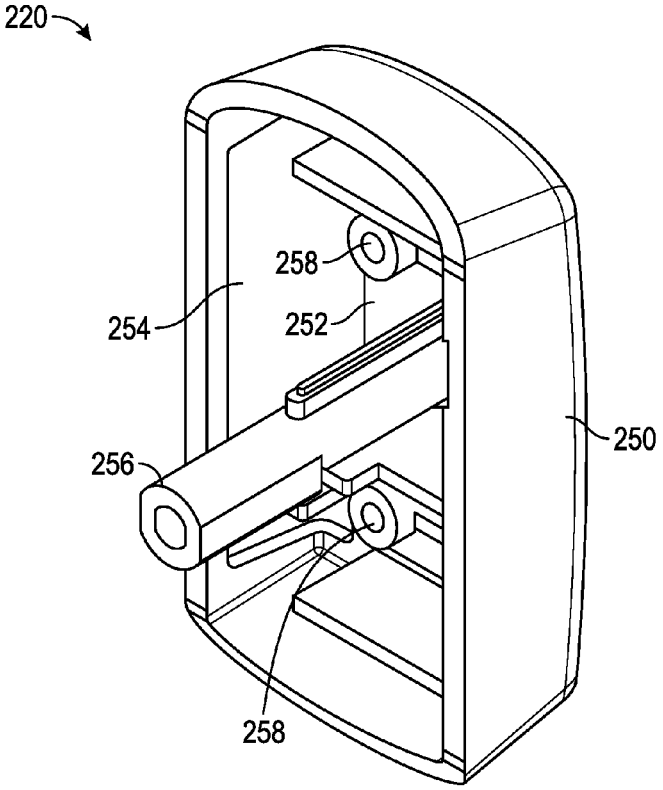
FIG. 4 is a perspective view of the example knob shown in FIG. 2.
Figure 5:
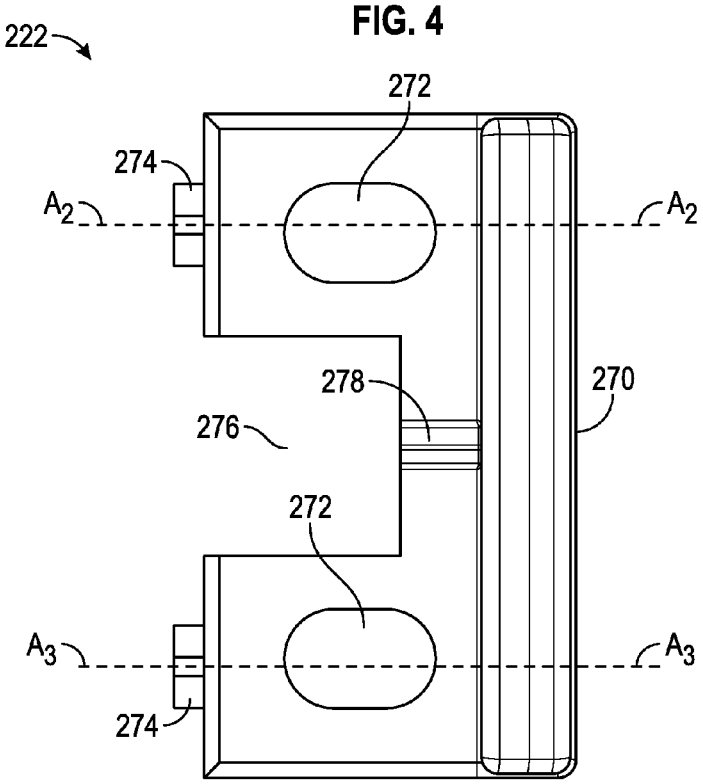
FIG. 5 is a rear view of the example button shown in FIG. 2.

FIG. 4 is a perspective view of the example knob 220 shown in FIG. 2; FIG. 5 is a rear view of the example button 222 shown in FIG. 2. With reference to FIG. 4, the knob 220 includes an exterior surface 250, an interior surface 252, a button aperture 254, an inner frame engagement stem 256, and one or more button engaging stems 258. With reference to FIG. 5, the button 222 includes an exterior pressing surface 270, one or more knob engaging openings 272, one or more spring engaging stems 274, a cutout 276, and a button flange 278.

With reference to FIGS. 4-5, when the knob 220 and the button 222 are assembled together, the exterior pressing surface 270 is accessible via the button aperture 254. By pressing and releasing the exterior pressing surface 270 the button 222 is pressed and released. Each of the button engaging stems 258 is surrounded by one of the knob engaging openings 272. Each of one or more springs (such as springs 224 discussed above in connection with FIG. 2) is longitudinally coupled along the axis $A_2$ and/or the axis $A_3$ to the button 222 via one of the one or more spring engaging stems 274, which are shaped and configured to be inserted into the end of a spring 224 (FIG. 2). Pressing the button 222 causes longitudinal compression of the one or more springs between the button 222 and the interior surface 252 of the knob 220 along axis $A_2$ and/or $A_3$. Pressing of the button also results in movement along axis $A_2$ and/or $A_3$ of the one or more knob engaging openings 272 relative to the one or more button engaging stems 258, each of which is surrounded by a knob engaging opening 272. In some examples, the knob engaging openings 272 are oblong in shape to all for transverse movement relative to the button engaging stems 258 in this manner.

When the knob 220 and the inner frame 136 (FIG. 2) are assembled, the inner frame engagement stem 256 extends towards (and in some examples, enters) the knob hole 192 (FIG. 2) in the inner frame 136 (FIG. 2). The pin 228 (FIGS. 2, 3) and/or the tab screw 232 (FIG. 3) enter the inner frame engagement stem 256 to rotatably couple the knob 220 to the inner frame 136 (FIG. 2). The cutout 276 in the button 222, permits transverse movement of the button 222 within the knob 220 without the inner frame engagement stem 256 interfering with the button 222 and potentially inhibiting pressing of the button 222.

The button flange 278 engages one of the one or more fingers 190 (FIG. 2) in the lower knob depression 189 (FIG. 2) when the button 222 is an un-pressed position. In some examples, engagement of the button flange 278 to a finger 190 (FIG. 2) de-mobilizes the knob 220 (and, in some examples, the second locking mechanism 144 (FIG. 2) as well), preventing or at least substantially preventing the knob 220's rotation unless and until the button 222 is pressed. Pressing the button 222 disengages the button flange 278 from a finger 190 (FIG. 2), permitting rotation of the knob 220 as described above. After the desired rotation of the knob 220 has taken place (e.g., from a locked position to a unlocked position or vice versa), the button 222 is then released when the knob 220 is in a position such that the button flange 278 engages a desired finger 190 in the lower knob depression 189, again preventing or at least substantially preventing the knob 220's rotation unless and until the button 222 is pressed again.

In some examples, one or more button connectors 226 (FIG. 2) includes a washer and a button screw, the button screw passing through a knob engaging opening 272 and into a bore in a button engaging stem 258, the washer slidably engaging an area on the button 222 surrounding a knob engaging opening 272 to permit transverse movement of the button 222 along the axis $A_2$ or the axis $A_3$ as described above.

Figure 6:
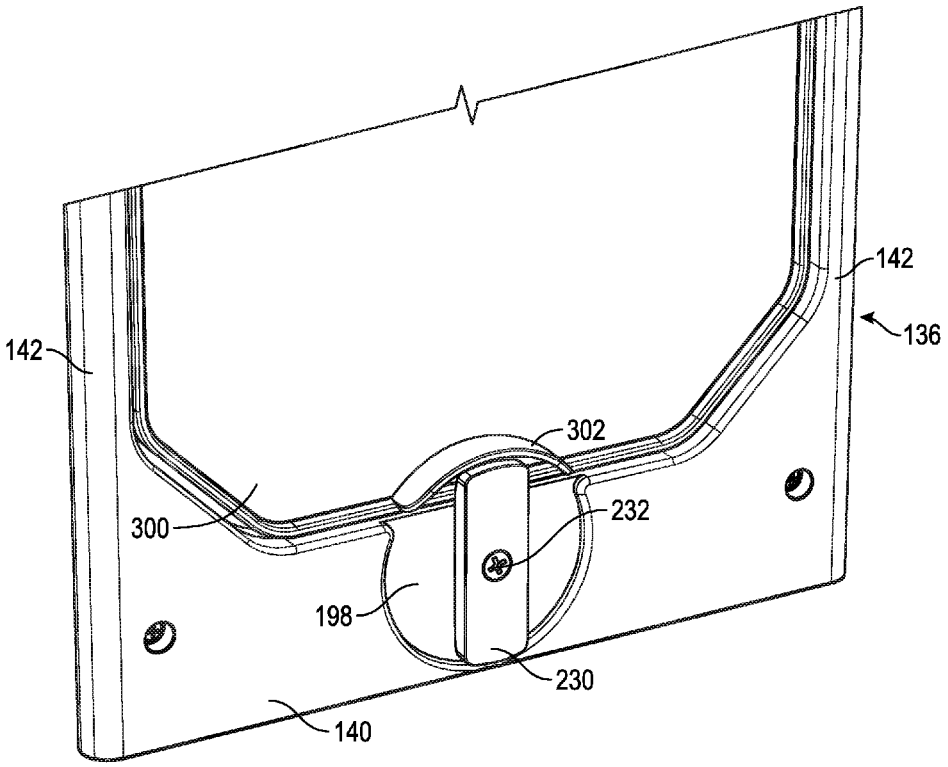
FIG. 6 is a perspective view of a portion of the inner frame shown in FIG. 3, including an alternative embodiment of a door.

FIG. 6 is a perspective view of a portion of the inner frame 136 of FIG. 3, including an alternative embodiment of a door. The inner frame 136 includes the bottom member 140, the side member 142, the tab depression 198, the tab 230, and the tab screw 232 as discussed above. In addition, in this example, the inner frame 136 houses a door 300, the door 300 including a cover 302.

The perimeter of the door 300 is configured to be housed within the opening defined by the inner frame 136. When the tab 230 is in a locked position (as in shown in FIG. 6), the cover 302 covers the tab 230, helping to prevent an animal from moving (e.g., unlocking) the tab 230, and also helping to prevent an animal from damaging the tab 230 (e.g., with teeth and/or claws). That is, the cover 302 helps to deny an animal access to the tab 230.

The profile of the cover 302 resembles the profile of a roof and can be any suitable shape such as a squared roof, curved roof, or pointed roof. In this example, the cover 302 is integrated with the door 300, extending outward from a face of the door. This can be accomplished through, e.g., casting, machining, insert molding, or otherwise simply securing the cover 302 to the door 300 after the door 300 has been manufactured.

In alternative examples to that shown, the cover 302 is integrated with another aspect of the security gate 100 (FIG. 1), such as the inner frame 136, the outer gate 112, the outer frame 110, or so forth. Furthermore, a cover of similar purpose and configuration to the cover 302 may alternatively or additionally be provided on the door (143, 300) or another aspect of the security gate 100 (FIG. 1) to cover at least a portion of the first locking mechanism 134 (FIG. 2), such as the knob 220 (FIG. 2).

The various components of the security gates of the present disclosure can be manufactured from a variety of materials or combinations of materials. In one example the outer frame 110 (FIG. 1), the first outer rail 122, the second outer rail 124, the one more complete inner rails 126 and the one or more partial inner rails 128 of the outer gate 112 (FIG. 1) are made from metal; the front panel 170 (FIG. 2) and the rear panel 172 (FIG. 3) of the inner frame are made from a relatively strong and rigid thermoplastic polymer (e.g., acrylonitrile butadiene styrene (ABS)), and the door 143 is made from a transparent or at least substantially transparent thermoplastic polymer (e.g., an optically transparent polycarbonate).

In some examples, component parts such as the tab 230 (FIG. 3), the knob 220 (FIG. 2), the button 222 (FIG. 2), are manufactured individually from a relatively strong thermoplastic polymer (e.g., ABS).

In some examples, immobilized junctions between component parts of a metal outer gate 112 (FIGS. 1, 3) are welded together, such as: the respective junctions between the first outer rail 122 and each of the complete inner rails 126 and the partial inner rails 128 (FIG. 1); the respective junctions between the crossbar 162 and the one or more partial inner rails 128 (FIG. 2); the respective junctions between the crossbar 162 and the one or more complete inner rails 126 (FIG. 2); the respective junctions between the second outer rail 124 and the one or more complete inner rails 126 (FIGS. 2-3); and the respective junctions between the second outer rail 124 and the one or more projections 160 (FIGS. 2-3). The various components and aspects of the security gates of the present disclosure alternatively can be manufactured from other materials or combinations of materials.

In some examples, component parts of the door (143, 300), such as the cover 302 (FIG. 6) and the protrusions 210 (FIG. 2) are made of the same material (e.g., a polycarbonate, as the rest of the door (143, 300).

In some examples, one or more components of the outer frame 110 (FIG. 1) and the outer gate 112 (FIG. 1) (e.g., the first vertical member 116, the second vertical member 118, the horizontal member 120, the first outer rail 122, the second outer rail 124, the one or more complete inner rails 126, the one or more partial inner rails 128 (FIG. 1)) are at least substantially hollow to reduce weight and manufacturing and/or shipping costs. In some examples, one or more components of the outer frame 110 (FIG. 1) and the outer gate 112 (FIG. 1) are solid (i.e., not hollowed out).

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A security gate, comprising:

an outer frame;

a gate at least partially disposed within the outer frame;

an inner frame disposed within the gate, the inner frame having at least one recess;

a door at least partially disposed within the inner frame; and at least one projection extending from the gate and engaging the at least one recess for supporting the inner frame within the gate;

wherein the gate comprises a crossbar;

wherein the inner frame comprises a slot, a first panel, and a second panel; and wherein the slot couples the first panel and the second panel to the crossbar.

2. The security gate of claim 1, wherein the at least one projection comprises two projections, wherein the at least one recess comprises two recesses, and wherein each of the two projections engages one of two recesses for supporting the inner frame within the gate.

3. The security gate of claim 1, wherein the gate comprises a metal and the inner frame comprises a thermoplastic polymer.

4. The security gate of claim 1, wherein the door comprises a transparent thermoplastic polymer.

5. The security gate of claim 1, wherein each of two projections extending from the door engage one of two cutouts disposed in the inner frame to pivotally couple the door to the inner frame.

6. The security gate of claim 1, further comprising a first locking mechanism detachably coupled to the gate, the first locking mechanism having a detached state in which the first locking mechanism is not coupled to the outer gate, an attached locked state in which the first locking mechanism prevents the gate from passing through the outer frame, and an attached unlocked state in which the first locking mechanism allows passage of the gate through the outer frame.

7. The security gate of claim 6, wherein the inner frame comprises a second locking mechanism comprising a locked state in which the second locking mechanism prevents the door from passing through the inner frame, and an unlocked state in which the second locking mechanism allows passage of the door through the inner frame.

8. The security gate of claim 7, wherein the second locking mechanism is detachably coupled to the inner frame and further comprises a detached state in which the second locking mechanism is not coupled to the inner frame.

9. The security gate of claim 7, wherein the door comprises a cover that covers at least a portion of the second locking mechanism when the second locking mechanism is in the locked state.

10. A security gate, comprising:

an outer frame;

a gate at least partially disposed within the outer frame;

an inner frame disposed within the gate, a door at least partially disposed within the inner frame; and a first locking mechanism comprising a locked state in which the first locking mechanism prevents the door from passing through the inner frame, and an unlocked state in which the first locking mechanism allows passage of the door through the inner frame, the first locking mechanism further comprising a rotating knob and a spring-loaded button at least partially disposed within the knob, the button configured to actuate rotation of the knob.

11. The security gate of claim 10, wherein the inner frame comprises an upper depression, a lower depression and a plurality of fingers in the lower depression, wherein the button comprises a pressed state, an unpressed state, and a flange, wherein the knob is disposed in the upper depression, and wherein the flange is engageable with each of the plurality of fingers when the button is in the unpressed state.

12. The security gate of claim 10, wherein the door comprises a cover that covers at least a portion of the first locking mechanism when the first locking mechanism is in the locked state.

13. The security gate of claim 10, further comprising a second locking mechanism detachably coupled to the gate, the second locking mechanism having a detached state in which the second locking mechanism is not coupled to the gate, an attached locked state in which the second locking mechanism prevents the gate from passing through the outer frame, and an attached unlocked state in which the second locking mechanism allows passage of the gate through the outer frame.

14. The security gate of claim 10, wherein the gate comprises a metal and the inner frame comprises a thermoplastic polymer.

15. The security gate of claim 10, wherein the door comprises a transparent thermoplastic polymer.

16. The security gate of claim 10, wherein the outer frame is adapted to be pressure-mounted to a structure.

17. The security gate of claim 10, wherein the gate comprises a plurality of complete inner rails coupled to each of a first outer rail and a second outer rail, and a plurality of partial inner rails coupled to each of the first outer rail and a crossbar, the crossbar being connected to two of the complete inner rails.

18. The security gate of claim 17, wherein the crossbar engages the inner frame to support the inner frame within the gate.

19. A security gate comprising:

an outer frame;

a gate comprising a metal and at least partially disposed within the outer frame;

an inner frame comprising a thermoplastic polymer and disposed within the gate, the inner frame having at least one recess;

a door comprising a transparent thermoplastic polymer and at least partially disposed within the inner frame;

at least one projection extending from the gate and engaging the at least one recess for supporting the inner frame within the gate;

a first locking mechanism comprising a locked state in which the first locking mechanism prevents the door from passing through the inner frame, and an unlocked state in which the first locking mechanism allows passage of the door through the inner frame, the first locking mechanism further comprising a rotating knob and a spring-loaded button at least partially disposed within the knob, the button configured to actuate rotation of the knob;

a second locking mechanism detachably coupled to the gate, the second locking mechanism having a detached state in which the second locking mechanism is not coupled to the gate, an attached locked state in which the second locking mechanism prevents the gate from passing through the outer frame, and an attached unlocked state in which the second locking mechanism allows passage of the gate through the outer frame; and a cover projecting from the door that covers at least a portion of the first locking mechanism when the first locking mechanism is in the locked state; and wherein the outer frame is adapted to be pressure-mounted to a structure.

* * * * *